United States Patent [19]

Stubbs

[11] Patent Number: 4,719,782

[45] Date of Patent: Jan. 19, 1988

[54] ROLLING MILLS

[75] Inventor: Dennis Stubbs, Sheffield, England

[73] Assignee: Hille Engineering Limited, Yorkshire, England

[21] Appl. No.: 857,253

[22] Filed: Apr. 30, 1986

[30] Foreign Application Priority Data

Apr. 30, 1985 [GB] United Kingdom ..... 8510927

[51] Int. Cl.[4] ..... B21H 1/22

[52] U.S. Cl. ..... 72/199; 72/244; 72/251

[58] Field of Search ..... 72/199, 244, 250, 251

[56] References Cited

U.S. PATENT DOCUMENTS 3,400,566 9/1968 Gauer ..... 72/199
3,580,032 5/1971 Stone ..... 72/199

FOREIGN PATENT DOCUMENTS 17313 1/1982 Japan ..... 72/199
215202 12/1984 Japan ..... 72/199
362212 12/1931 United Kingdom .

*Primary Examiner*—W. D. Bray
*Attorney, Agent, or Firm*—Schwartz, Jeffery, Schwaab, Mack, Blumenthal & Evans

[57] ABSTRACT

A machine for controlling the width of workpieces rolled between horizontal rolls includes a pair of vertical edger rolls which are mounted on respective pivotable arms. The pivots for the arms include an eccentric whereby the rolls can be moved closer together or further apart to accommodate workpieces of different width. A cam mechanism is provided to increase and decrease the separation between the rolls. This mechanism bears against the arms on the opposite sides of the pivots to the edger rolls.

3 Claims, 3 Drawing Figures

ROLLING MILLS

This invention relates to rolling mills having provision for controlling the width-wise spread of the workpiece as it is rolled in the mill.

During the rolling of elongate metal workpieces there is a certain amount of sideways spreading producing an increase in width as the thickness of the workpiece is reduced. In some applications this increase in width of the workpiece is not important but, on the other hand, in some instances, such as in the rolling of "flats" for the subsequent manufacture of leaf springs, it is necessary for the rolled flats to be of a predetermined width as well as a predetermined thickness and so it is necessary to control the width of the workpiece as it is rolled. When rolling "flats", the workpiece is rolled a number of times between the rolls of the mill, with the separation of the rolls being reduced between successive passes. It is necessary to control the width of the workpiece as it is rolled.

It is known for a rolling mill having horizontal rolls to also have a pair of vertical edger rolls so arranged that the edger rolls bear against the opposite side edges of the workpiece and thus control its width as it is rolled. Usually the horizontal rolls are capable of rolling workpieces of different widths and so the positions of the vertical rolls relative to the passline have to be changed for each desired width of workpiece.

It is an object of the present invention to provide a rolling mill having edger rolls adjustable to accommodate workpieces of a range of widths.

According to the present invention, a rolling mill comprises a housing structure rotatably supporting at least one pair of horizontal work rolls, a pair of support arms each pivotally supported at a position between its ends on said structure and an eccentric member between each arm and its support, a pair of vertical edger rolls rotatably supported at one end of the respective support arms, a cam member displaceable between the arms to engage the arms on the sides of the pivot opposite to the edger rolls to cause said arms to pivot about the housing structure and means for displacing said cam member relative to the arms.

In use, the cam member is initially positioned so that the edger rolls are spaced apart by a maximum amount. This permits the workpiece to be passed through the mill without engaging the edger rolls and, thereafter, the cam member is displaced thereby causing the arms to pivot so as to reduce the separation of the edger rolls. The workpiece is then rolled between the horizontal rolls and the vertical rolls so that the vertical edger rolls control the width of the workpiece.

By adjusting the eccentric member between each arm and its support, the position of the edger roll on that arm relative to the passline of the machine can be adjusted. In this way, workpieces of different widths can be produced in the machine. Thus, the displacement of the cam member through a fixed distance of travel causes the arms to be pivoted about their pivots but, because the arms are eccentrically mounted upon the structure, the position of the edger rolls and their movement towards and away from each other is varied depending upon the degree of eccentricity between the arms and the structure.

Further adjustment of the width of the workpiece, as defined by the edger rolls, can be made by making that part of each arm which bears against the cam surface to be displaceable in the direction at right angles to the length of the arm. Conveniently, the cam member is engaged by a roller on each arm and the roller is supported on a screw device which permits the roller to be moved in the direction at right angles to the length of the arm.

In order that the invention may be more readiy understood, it will now be described, by way of example only, with reference to the accompanying drawings, in which.

Figure 1:
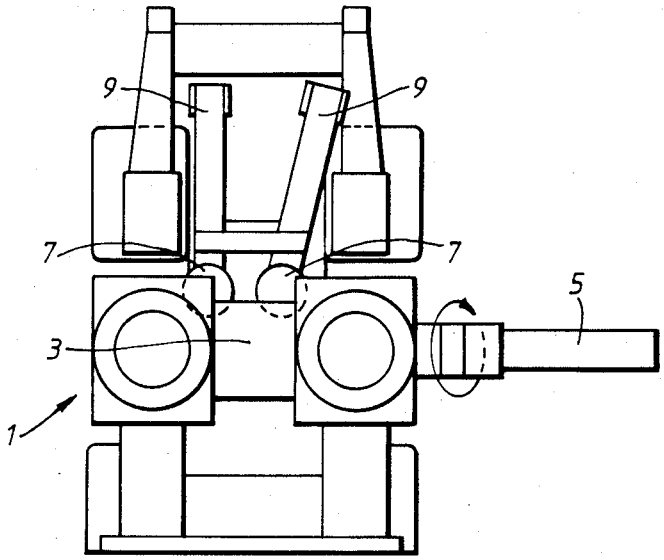
FIG. 1 is a top plan view of a rolling mill in accordance with the present invention.

Referring to FIG. 1, a rolling mill for rolling elongate metal workpieces, such as "flats", for producing metal springs consists of a housing structure 1 rotatably supporting a pair of rolls 3 which are arranged with their longitudinal axes horizontal. These rolls are driven by way of roll spindles 5. To one side of, and close to, the horizontal rolls 3 there are a pair of rolls 7 which are arranged with their axes vertical. Immediately after passing through the horizontal rolls the workpiece passes between these vertical edger rolls which control the spread of the workpiece as it is rolled and thus determine the width of the workpiece. The rolls 7 are shown mounted at the ends of a pair of arms 9.

Figure 2:
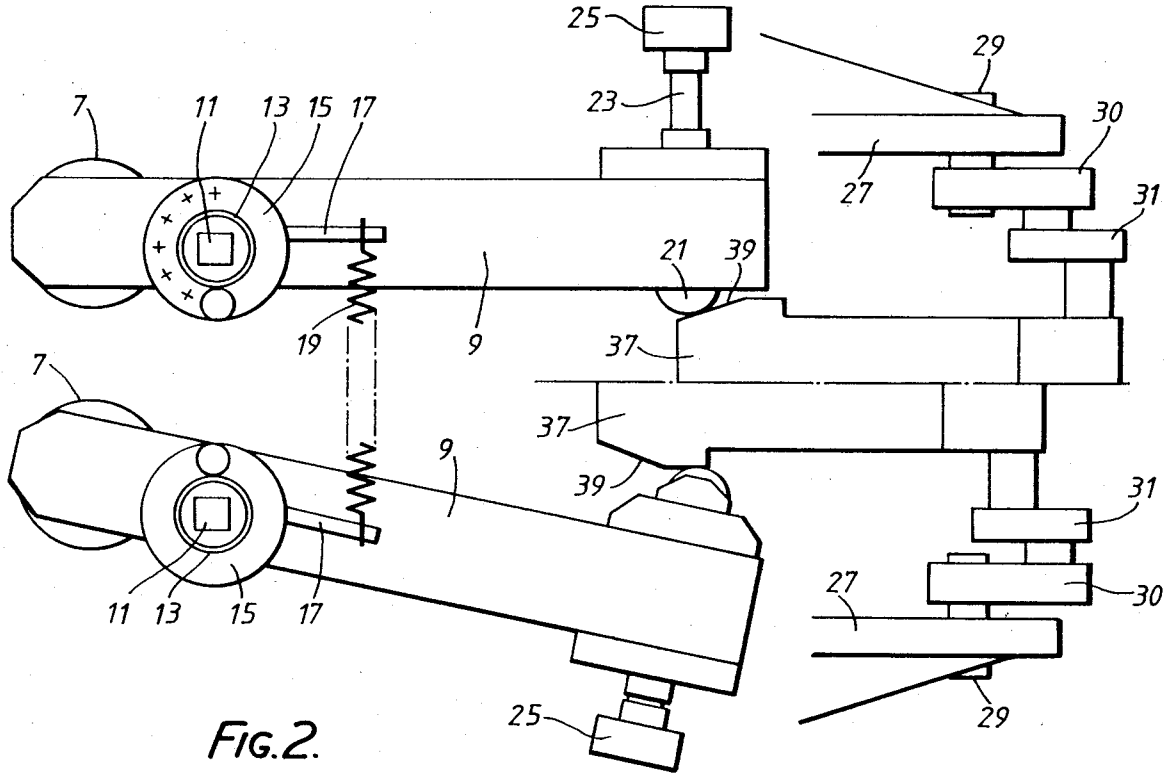
FIG. 2 is a plan view of part of the rolling mill shown in FIG. 1.
Figure 3:
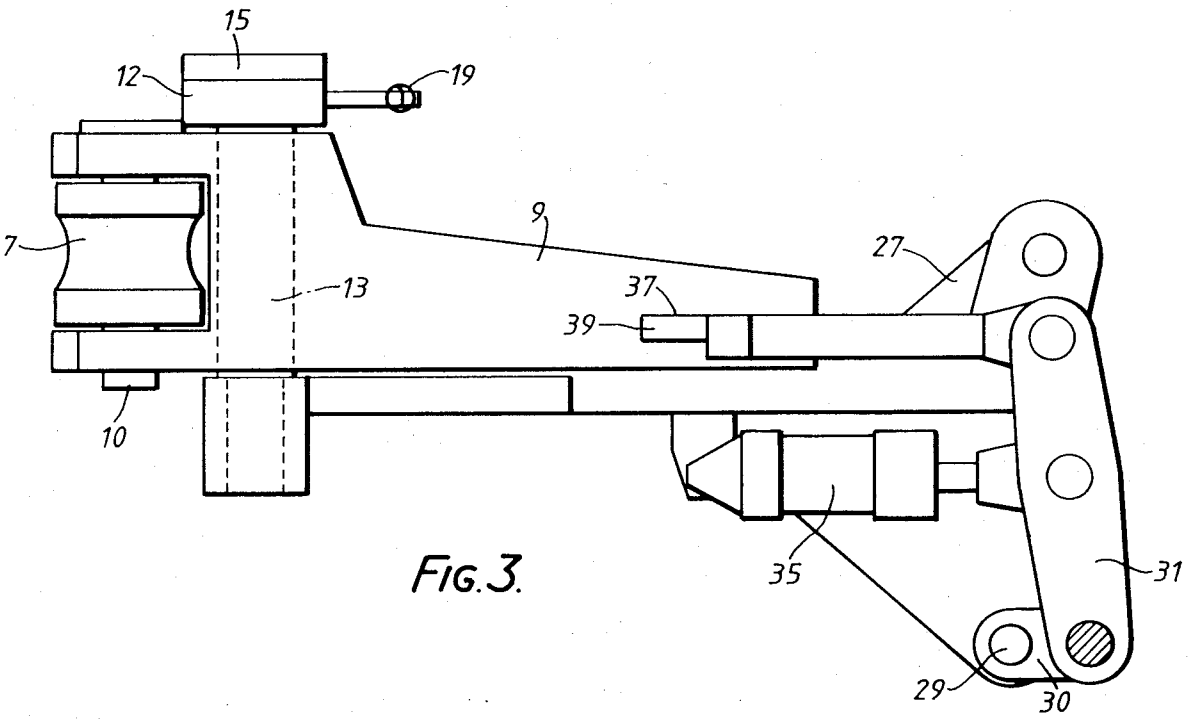
FIG. 3 is a partial side elevation of the part of the rolling mill shown in FIG. 2.

Referring particularly to FIGS. 2 and 3, each arm 9 rotatably supports its edger roll 7 at one end of the arm on a post 10. The arms 9 are each pivoted on a respective fixed pivot 11 on a portion 12 of the housing structure 1 of the mill. An eccentric sleeve 13 is mounted on each pivot 11 and the arm 9 is mounted on the eccentric sleeve. Thus, by rotating the eccentric sleeve 13 relative to the pivot 11, the degree of eccentricity can be adjusted. The upper end of the sleeve has an annular flange 15 containing a number of openings (not shown) and, by rotating this flange to a predetermined position, the degree of eccentricity is adjusted. A pin (not shown) is introduced into the particular opening of the sleeve and an opening (not shown) in the mill housing structure to lock the sleeve relative to the housing structure. Each arm 9 carries a post 17 on the side of the pivot opposite to the rollers and a coil spring 19 is connected between the posts to bias the posts towards each other and thus displace the rolls 7 away from each other.

Adjacent to the end of each arm which is opposite to that which carries the roller 7 there is a roller 21 located on the inner side of the arm. This roller is mounted in a housing with a screw mechanism 23 for displacing the roller in the direction at right angles to the length of the arm 9. An indicator 25 indicates the position of the roller. The mill housing structure 1 includes a pair of upstanding plates 27 and, at the lower sides of the plates, there is a horizontal pin 29 carrying a link 30. The two links 27 and 30 are connected together and pivotally support a lever arm 31. At the upper end of this arm there is a horizontally displaceable cam member 37 which bears against the rollers 21. At a position intermediate to the ends of link 31 there is a connection to a hydraulic piston-cylinder device 35. On operating this piston-cylinder device, the link 31 is pivoted about the links 30 and causes the cam member 37 to be displaced backwards and forwards. This cam member carries a pair of opposed cam surfaces 39 against which the rollers 21 are biased by the spring 19 and displacement of the cam member causes the arms to be pivoted about the pivots 11.

In the withdrawn position, shown in the upper half of FIG. 2, the rolls are in their outermost position which enables the workpiece to be passed between them without engaging either of them.

When the cam member 37 is displaced to the left, as shown in the lower half of FIG. 2, the rollers 21 are forced apart and the edger rolls 7 are forced closer together so that, when the workpiece is passed between them, they control the width of the workpiece.

To accommodate workpieces of different widths, firstly a position of the eccentric sleeve is chosen to give approximately the required separation of the rolls 7 and then the final adjustment is made by the screw mechanism 23.

I claim:

1. A rolling mill comprising:

a housing structure;

a first pair of elongate mill rolls positioned one above the other with their longitudinal axes horizontal and parallel, said rolls being rotatably supported in the housing structure;

means for rotating said rolls to engage opposite faces of a workpiece passed therebetween;

a second pair of elongate mill rolls positioned side-by-side with their longitudinal axes vertical and parallel to engage opposite edges of a workpiece;

a pair of support arms each having a first end and an opposite end, said second pair of rolls being rotatably supported at said first ends of the support arms;

each support arm being pivotal about a position between its first and opposite ends on respective pivots on said housing structure;

an adjustable eccentric member positioned between each support arm and its pivot;

a cam member displaceable between the arms to engage the arms at a location opposite of the pivots from the second pair of mill rolls to cause said arms to pivot about the respective pivots to move the rolls of the second pair toward and away from each other; and means for displacing the cam member relative to the arms.

2. A rolling mill as claimed in claim 1, wherein the cam member is of elongate form and has cam surfaces on a pair of opposite sides, said cam member being displaceable in the direction of its length by means including a fluid operable piston-cylinder device.

3. A rolling mill as claimed in claim 2, in which each arm carries a roller, and spring means connected between the arms urge the rollers into engagement with the cam surfaces.

* * * * *